US006152629A

United States Patent [19]

Yoneyama et al.

[11] Patent Number: 6,152,629

[45] Date of Patent: Nov. 28, 2000

[54] IMAGE FORMING APPARATUS

[75] Inventors: Tsuyoshi Yoneyama, Toyokawa; Yuuji Takarabe; Takashi Onishi, both of Toyohashi, all of Japan

[73] Assignee: Minolta Co., Ltd., Osaka, Japan

[21] Appl. No.: 09/391,382

[22] Filed: Sep. 8, 1999

[30] Foreign Application Priority Data

Sep. 9, 1998 [JP] Japan ..... 10-255840

[51] Int. Cl.[7] ..... B41J 11/42

[52] U.S. Cl. ..... 400/582; 400/76; 400/70; 400/61

[58] Field of Search ..... 400/582, 76, 70, 400/61; 271/298

[56] References Cited

U.S. PATENT DOCUMENTS 5,435,544 7/1995 Mandel ..... 271/298
5,551,686 9/1996 Sanchez et al. ..... 271/298
5,777,882 7/1998 Salgado ..... 364/478.02
5,898,592 4/1999 Salgado et al. ..... 364/478.02
5,961,115 10/1999 Blanck et al. ..... 271/263
5,970,228 10/1999 Nezu ..... 395/186

*Primary Examiner*—John S. Hilten
*Assistant Examiner*—Charles H. Nolan, Jr.
*Attorney, Agent, or Firm*—McDermott, Will & Emery

[57] ABSTRACT

A printer for forming images in accordance with print jobs from computers connected to a network, and which discharges the sheets bearing the formed image to a plurality of bins per job. A printer which outputs to a computer a signal warning that sheets have not been removed at a specific event of turning ON the power source of a computer or power source of a printer, or canceling a sleep mode when paper has been forgotten and remains in a bin.

27 Claims, 5 Drawing Sheets

IMAGE FORMING APPARATUS

This application is based on Patent Application No. HEI 10-255840 filed in Japan, the entire content of which is hereby incorporated by reference.

BACKGROUND OF THE INVENTION

1. Field of the Invention

The present invention relates to an image forming apparatus provided with a plurality of bins, and specifically relates to an image forming apparatus connectable to a plurality of external devices (terminals) so as to form images based on data transmitted from an external device.

2. Description of the Related Art

In conventional printers provided with a plurality of bins and connected to a network, the bins may be used as mailboxes (where the sheets of a print job from a terminal are discharged to a bin of the same terminal). Japanese Laid-Open Patent Application No. HEI 6-316137 discloses a system for displaying on a display unit the system information relating to the bins such as "bin (mail bin) full" and the like.

It is further known that after print instructions are transmitted from an external device, such as a personal printer (hereinafter referred to as "PC") connected to the network, the data transmission condition to the printer (e.g., page 5 of 10 pages currently being transmitted) can be displayed on the PC side display prior to starting the print operation, so as to allow management of the current data transmission condition.

The mail bin may be exclusively reserved for long periods, however, when a user continues to operate the PC and forgets to remove the paper after a print job has been specified for the printer from a PC connected to the network. As a result, the use conditions for other users is adversely affected. In the conventional art, forgetting to remove paper can be verified on the display units of the printer or the PC. Even though displayed, such papers still may not be removed when a user is busy, with the disadvantageous result that the bin is exclusively reserved for long periods.

SUMMARY OF THE INVENTION

An object of the invention is to eliminate the previously described disadvantages.

Another object of the present invention is to provide a device which reminds a user to remove paper.

Another object of the present invention is to provide a device which reminds a user to remove paper at a predetermined timing.

These and other objects are attained by a printer comprising a receptor for receiving a job from an external device, a print unit for printing on sheets based on the job, a paper accommodating unit for receiving the printed sheets, a detector for detecting the ON state of the power source of the external device, a discriminator for discriminating whether or not sheets remain in the paper accommodating unit when the power source ON state is detected, and a transmitter for transmitting a warning signal to the external device when residual sheets are discriminated by the discriminator.

The objects of the present invention are further attained by a printer comprising a receptor for receiving a job from an external device, a print unit for printing on sheets based on the job, a paper accommodating unit for receiving the printed sheets, a detector for detecting the ON state of the power source of the printer, a discriminator for discriminating whether or not sheets remain in the paper accommodating unit when the power source ON state is detected, and a transmitter for transmitting a warning signal to the external device when residual sheets are discriminated by the discriminator.

The invention itself, together with further objects and attendant advantages will be best understood by reference to the following detailed description taken in conjunction with the accompanying drawings.

BRIEF DESCRIPTION OF THE DRAWINGS

In the following description, like parts are designated by like reference numbers throughout the several drawings.

DESCRIPTION OF THE PREFERRED EMBODIMENTS

The embodiments of the present invention are described hereinafter.

Figure 1:
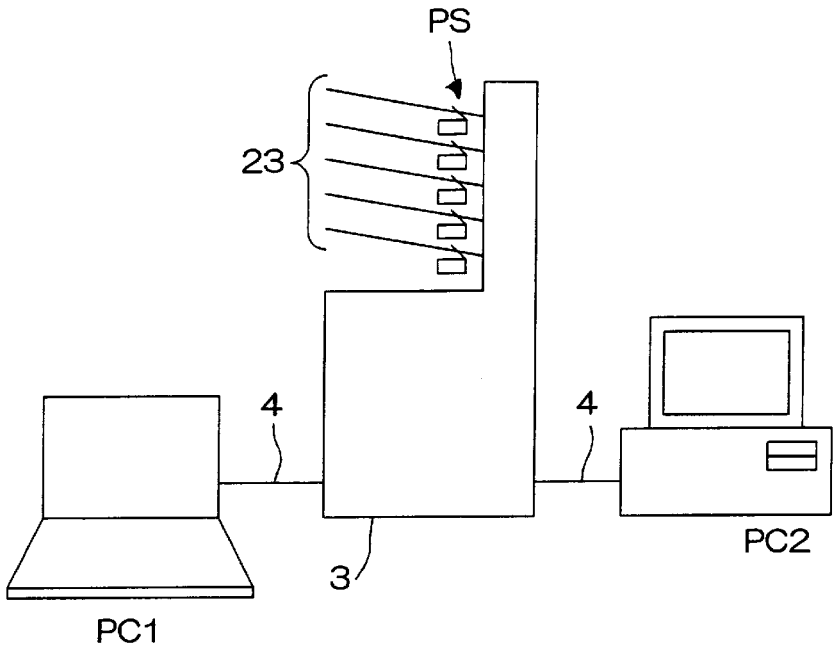
FIG. 1 shows the general construction of a system including a printer.

FIG. 1 shows the general construction of a system for forming images constructed by a network. A plurality of external devices in the form of personal computers 1 and 2 (hereinafter referred to as "PC1" and "PC2"), and a printer 3 are connected via a local area network (LAN) 4. The PC1 is a notebook type personal computer, and the pC2 is a desktop type personal computer. The printer 3 executes printing based on a print job transmitted from the PC1 or PC2. The printer 3 is provided with a discharge tray 23 (i.e., mail bin) having a plurality of bins for sorting printed sheets. Each bin is provided with a paper detection sensor PS for detecting the presence/absence of discharged sheets. Details of the construction of the printer 3 are discussed later.

Figure 2:
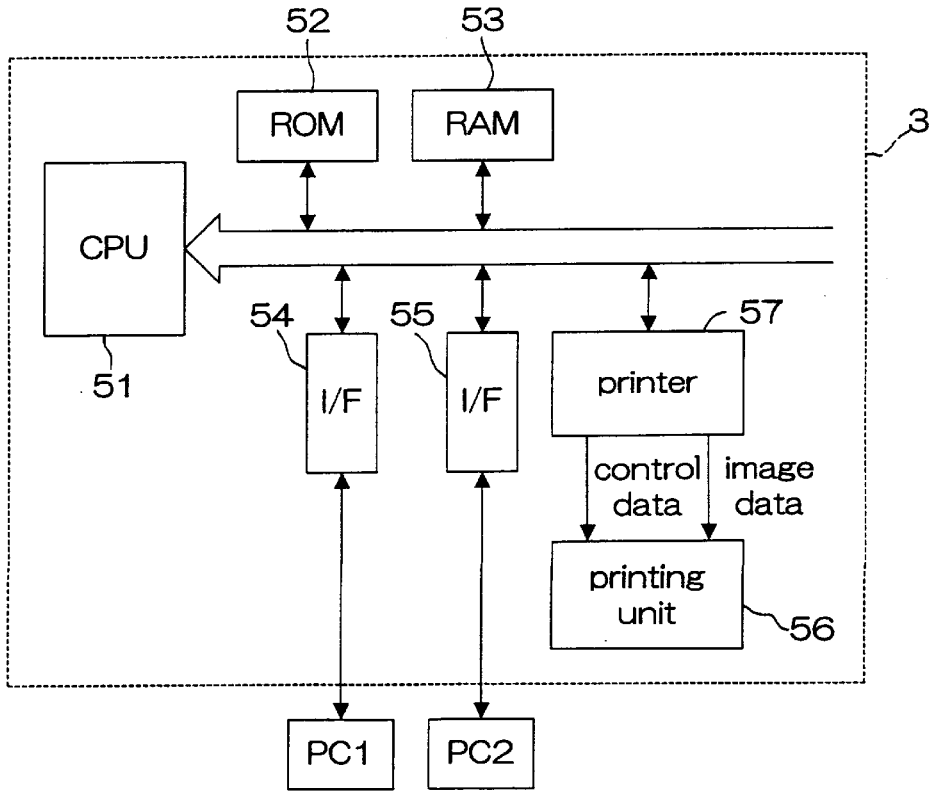
FIG. 2 is a block diagram of a printer.

FIG. 2 shows the block construction of the printer 3. The printer 3 comprises a central processing unit (CPU) 51 for controlling all operations, a read only memory (ROM) 52 for storing processing programs, random access memory (RAM) 53 for storing data, interfaces 54 and 55, and a printer CPU 57 for controlling a print unit 56 which performs the printing (this CPU also controls the sheet discharge to the mail bin).

Image data representing text or graphics and control data (command data) for controlling the printer 3 are output to the printer 3 from the PC1 and PC2 via the interfaces 54 and 55. These control data include signals specifying printing instructions, and various command data such as discrimination signals of the PC1 and POC2 transmitting the control data, signals specifying the mail bin for sheet discharge, signals representing the ON or OFF state of the PC power source, signals to put the PC in sleep mode, signals to release the PC from the sleep mode and the like. The signals specifying the mail bin are signals specifying the bin to which the printed sheets are discharged by the printer 3.

The CPU 51 issues instructions for printing by the printing unit 56 to the printer CPU 57 in accordance with received signals, and also switches the bin in use. The CPU 51 controls the discharge of the printed sheet to a mail bin selected in accordance with the mail bin specifying signal included in the control data. When the discharge tray 23 is used as the mailbox, the sheets are discharged to a fixed mailbox corresponding to the PC1 or PC2 which output the print job instructions based on the discrimination signal.

The CPU 51 is provided with a terminal discrimination function for discriminating the terminal based on the reception signal from the PC1 and PC2 (terminal), a condition change detection function for detecting the ON/OFF state of the power source of a discriminated terminal and detecting the setting/cancellation of the sleep mode, a bin discrimination function for discriminating a bin receiving discharged sheets of a print job from a terminal when the aforesaid condition change is detected and before the condition change is accomplished, and a function for outputting to as terminal the specification signals when residual sheets are detected in a bin via the signal from the paper detection sensor PS. The processing sequence is described below.

The printer unit 3 is provided with a mode for using the discharge tray 23 as a mailbox, and a mode for using the discharge tray 23 as separate job tray. In the former mode a sheet printed based on a print job from the same PC is discharged to the same mailbox, and in the latter mode printed sheets are discharged to different bins for each print job.

The printer 3 performs printing via the print unit 56 in accordance with the received image data when a print instruction signal is received from the PC1 or PC2 via the interfaces 54, 55. The printing method may be any well known laser beam printing method.

Figure 3:
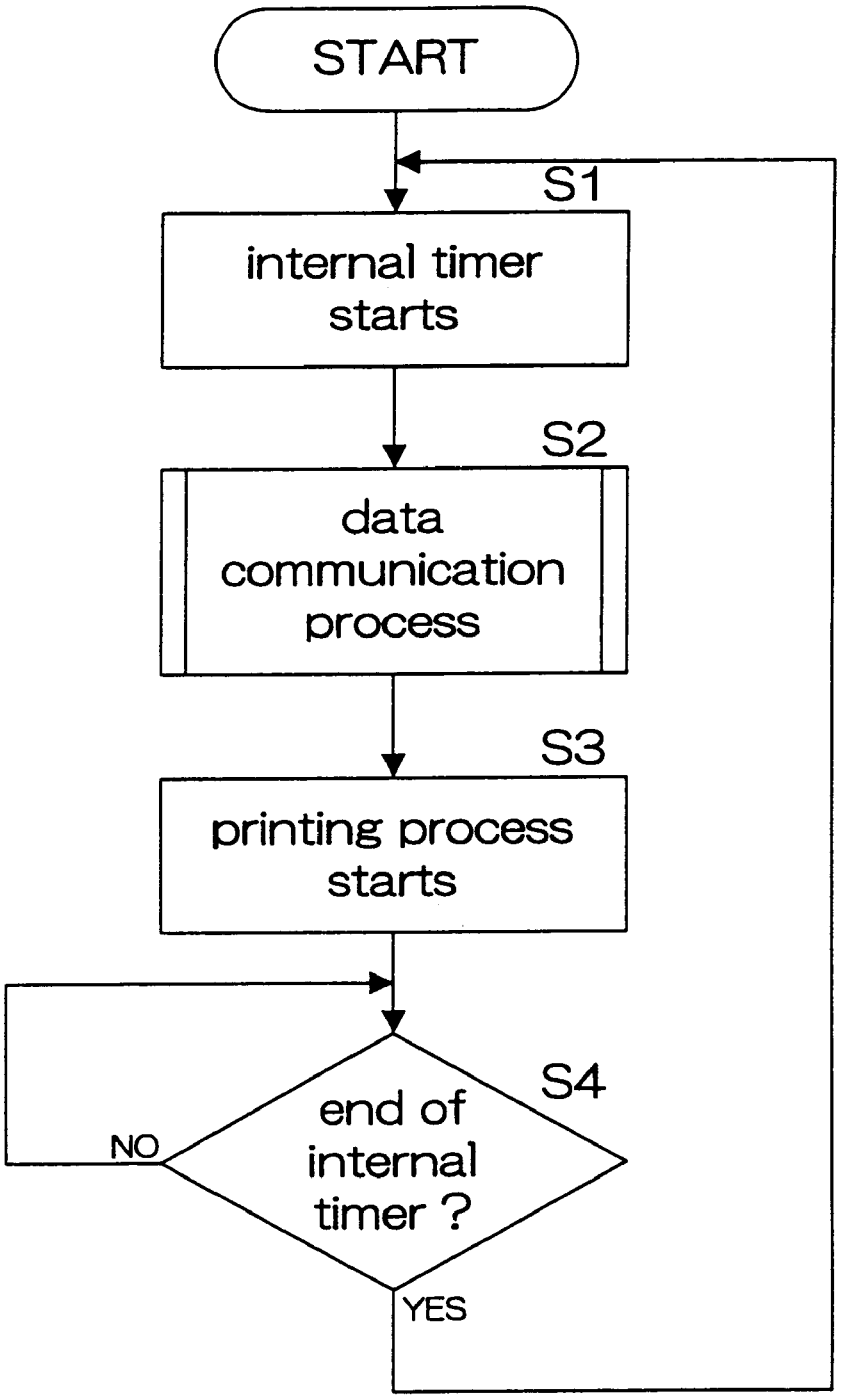
FIG. 3 is a flow chart showing the printer controls.
Figure 4:
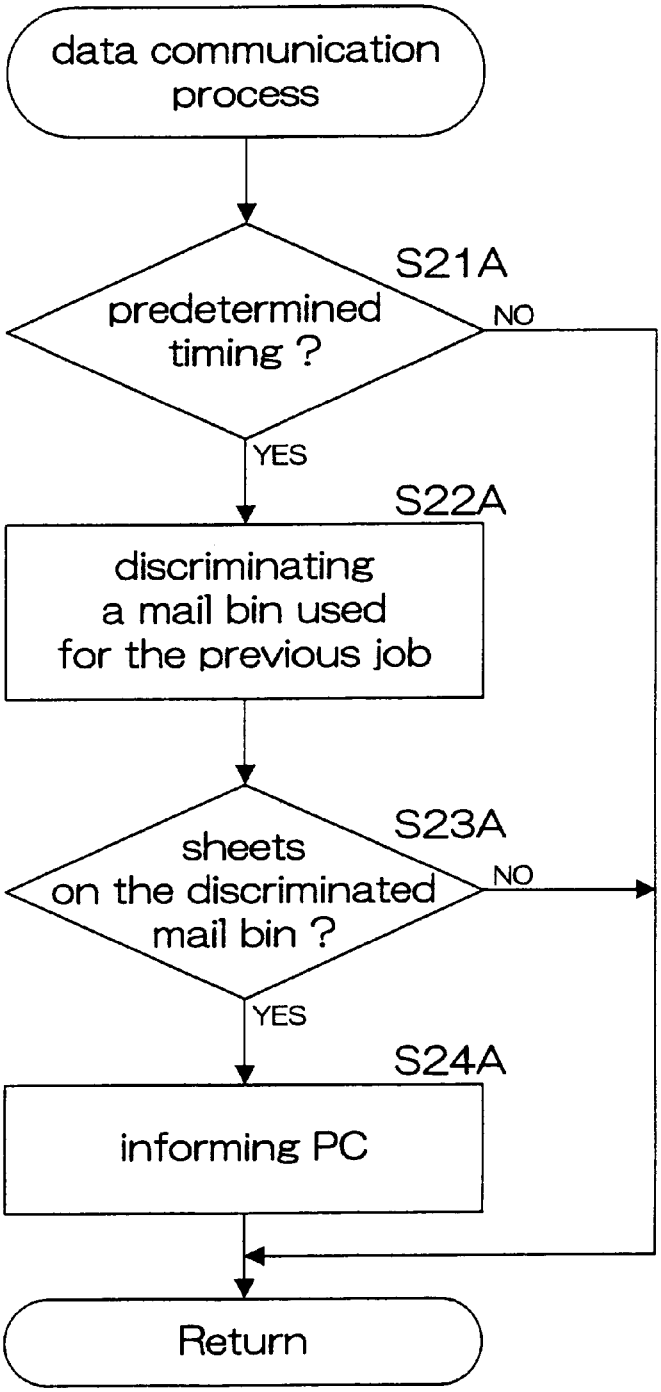
FIG. 4 is a flow chart showing the data communication process of a first embodiment.

The controls executed by the CPU 51 of the printer 3 are described below with reference to the flow chart of FIG. 3. The CPU 51 starts an internal timer to stipulate 1-routine of printer operation (i.e., check whether or not a process is normal) (step S1). Then, a data communication process is executed between the printer 3 and a personal computer (PC) (S2). After the printing process starts (S3), the end of the internal timer is detected (S4). The data communication process of step S2 is described below with reference to FIG. 4. First, in step S21A, a determination is made as to whether or not the printer has received a predetermined signal input from a PC. Predetermined signals include signal representing the ON/OFF state of the PC power source, and signals representing the setting or canceling of the PC sleep mode.

When such a signal is detected on the printer 3 side (step S21A: YES), in step S22A the mail bin is discriminated using the previous print job by this PC. The usage history of this mail bin is stored in a memory 57 (FIG. 2). The mail bin used for the previous print job by this PC is discriminated via this usage history. The mail bin used in the previous print job by this PC is not limited to a single mail bin, and may be a plurality of mail bins.

In step 23A, a check is made to detect whether or not the sheets have been removed from the mail bin used in the previous print job by this PC (i.e., whether or not there are residual sheets). When there is a residual sheet in the mail bin (step S23A: YES), in step S24A a signal is output to alert the PC which discharged the sheets to this mail bin of the present condition. The signal output to the PC is specifically a signal for displaying the message "paper not removed" on the screen of the PC. Since this message cannot be displayed on the screen when the PC enters the sleep mode, the alert that sheets have not been removed may be a sound or buzzer. When the PC is turned OFF, the message "sheets not removed" may be displayed on the PC screen after deferring the PC OFF state for a set time. The position of the mail bin accommodating the forgotten sheets may also be displayed on screen. In this instance, a user quickly recognizes the position of her own mail bin, and rapidly access the mail bin.

For example, when sheets based on a print job specified from the PC1 are discharged to the third and fifth bins from the top of the mail bin and have not been removed, a user may switch ON/OFF the power source of the PC1, or set/cancel the sleep mode of the PC1. In this instance, signals representing these conditions are sent as control data to the printer 3. Then, the printer 3 outputs signals to the PC1 to display the message "sheets not removed from third and fifth bins" or effect an audio alarm.

A second embodiment is described below. The general construction of the printer is identical to that of the first embodiment. In the first embodiment described above, the data transmission process of FIG. 3 transmits signals from the PC to the printer to set/cancel the sleep mode to turn ON/OFF the PC power source. In the second embodiment described below, the data transmission process of FIG. 3 transmits signals from the printer to the PC to set/cancel the sleep mode (i.e., power save mode) to turn ON/OFF the printer.

Figure 5:
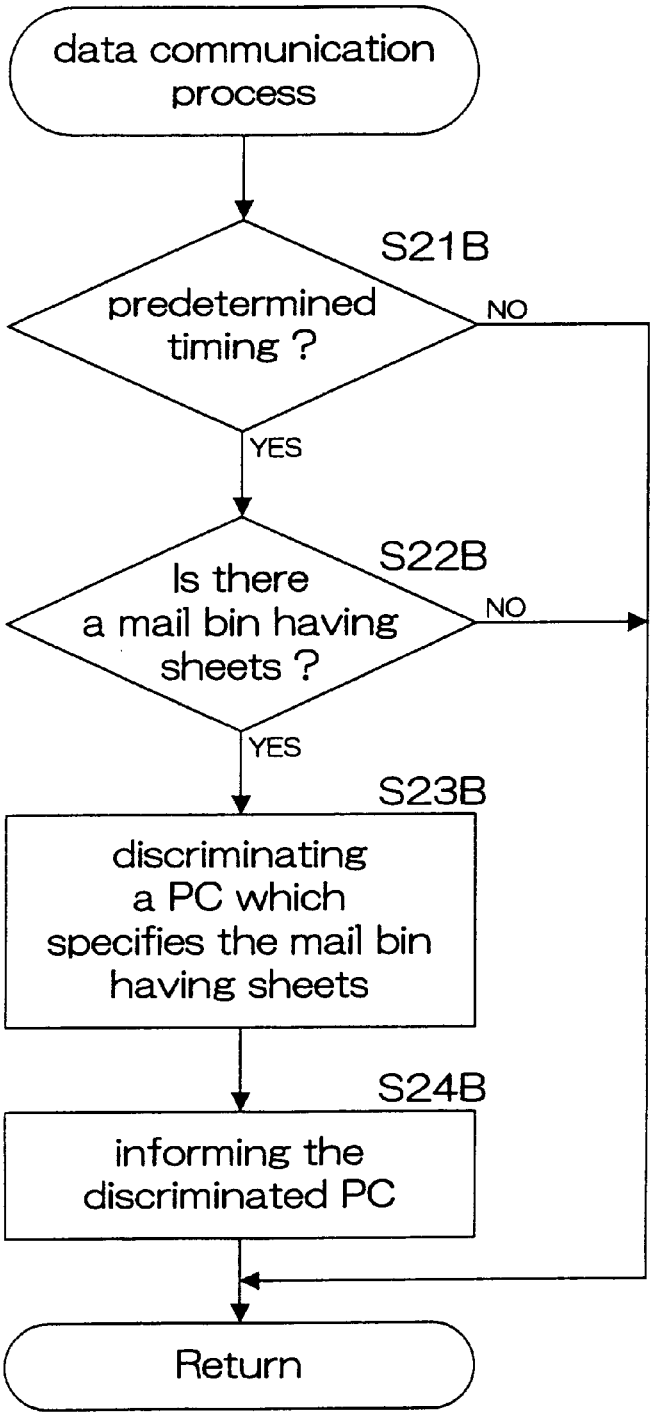
FIG. 5 is a flow chart showing a data communication process of a second embodiment.

A flow chart of the data communication process is shown in FIG. 5. In the flow chart, when the printer transmits the aforesaid signal to the PC (step S21B: YES), in step S22B whether or not there is a residual sheet in the mail bin, i.e., whether or not sheets remain in the mail bin, is discriminated. When sheets remain in the mail bin (the mail bin is not limited to a single mail bin and may be a plurality of mail bins similar tot he first embodiment), in step S23B the PC which specified the print job discharged to this mail bin is discriminated. In step S24B the printer transmits to this PC a signal to display the message "paper not removed" on the screen of the discriminated PC. Similar to the first embodiment, a warning concerning the residual sheets may be output as a sound or buzzer. It is also beneficial to the user when the position of the mail bin accommodating the residual sheets is displayed.

For example, when sheets based on a print job specified from the PC1 are discharged to the third and fifth bins and have not been removed, a user may switch ON/OFF the power source of the printer, or set/cancel the sleep mode of the printer. Whether or not there are residual sheets in the mail bin, i.e., whether or not sheets have not been removed from the mail bin, is discriminated by the paper detection sensor PS. Furthermore, when sheets have not been removed from the third and fifth bins, a signal may be output to the PC 1 which specified the discharge of the sheets to the third and the fifth bins to display the message "sheets not removed from third and fifth bins."

Figure 6:
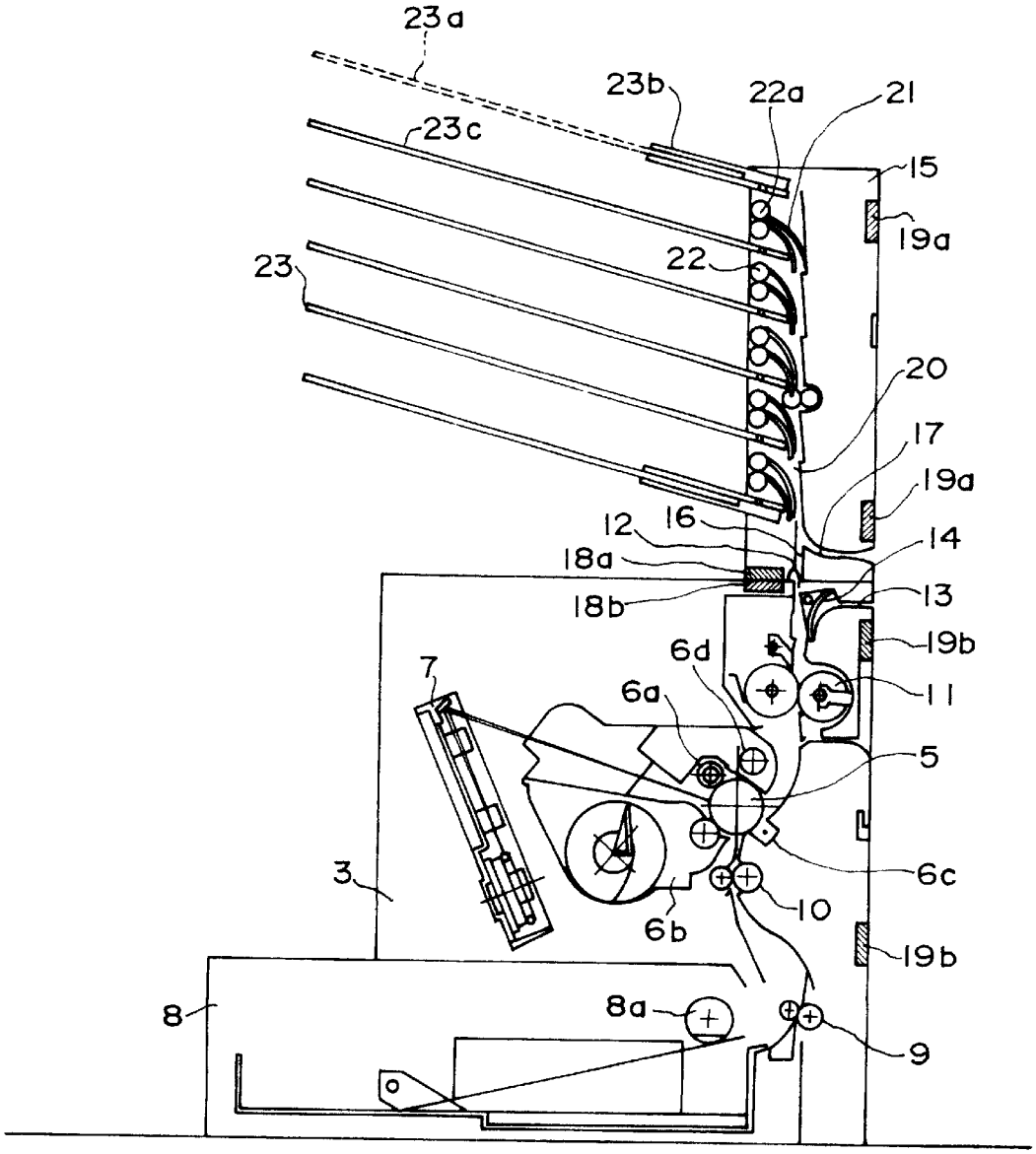
FIG. 6 shows the construction of a printer.

FIG. 6 shows the construction of a printer 3. At the top of the body of the printer 3 is provided a sheet post processing device having a discharge tray with a plurality of bins. Within the printer 3 is a photosensitive member 5. Around the periphery of the photosensitive member 5, sequentially in the direction of rotation of the photosensitive 5, are arranged a changer 6*a*, developing device 6*b* accommodating developer, a transfer device 6*c*, and a cleaning device 6*d*. An exposure device 7 for forming an electrostatic latent image on the surface of the photosensitive member 5 is arranged such that a laser beam reaches an image recording position between the charger 6*a* and the developing device 6*b*. The bottom part of the body is provided with a paper cassette 8 having an internal feed roller 8*a*. The paper cassette is not limited to a single cassette inasmuch as a plurality of cassettes may be installed to accommodate paper of various sizes.

After the surface of the photosensitive member 5 is uniformly changed by the charger 6*a*, an image is recorded on the surface of the photosensitive member 5 via a laser beam emitted from the exposure device 7, and the latent image is developed as a toner image on the surface of the photosensitive member 5 using toner supplied by the developing device 6*b*. On the other hand, a paper sheet fed by the feed roller 8*a* is transported to the registration roller 10 by a transport roller 9. The registration roller 10 adjusts the leading edge position of the sheet, and transports the sheet to the transfer device 6*c* synchronously with the toner image formed on the surface of the photosensitive member 5. Then, the toner image formed on the surface of the photosensitive member 5 is transferred onto the sheets via the transfer device 6*c*. Thereafter, the residual toner is removed from the surface of the photosensitive member 5 by the cleaning device 6d in preparation for the next image forming process. The sheet bearing the transferred toner image passes through a fixing device 11 which fixes the toner image thereon, and the sheet is then transported through a transport path directly behind the fixing device 11 to a sheet post processing device 15.

In the present embodiment this sheet transport path is separated into paths 12 and 13, and the sheet transport path to be used is switched using a distribution gate 14 which pivots upon a support. FIG. 6 shows the state wherein the sheet transport path 12 is selected. In this instance, a sheet passes through the transport path 12 and the transport path 16 of the sheet post processing device 15, and is delivered to a common shared path 20 within the sheet post processing device 15. Above the common shared path 20 are provided a plurality of distribution gates 21, and one distribution gate 21 is selected and pivots via instructions from a printer controller not shown in the drawing. The sheet is guided by a pair of discharge rollers 22 along the gate 21 to the discharge tray 23, so as to be sequentially ejected to the discharge tray 23 sequentially from the first page with the printed surface facing downward. Each bin is provided with a sheet detection sensor PS (FIG. 1).

The present invention is not limited to the construction of the aforesaid embodiment and may be variously modified. For example, although the power source is turned ON/OFF or the sleep mode set/released when a warning is issued for residual sheets in the previously described embodiments, other condition changes may be detected.

According to the previously described embodiments, after an external device such as a warning of residual sheets is output after a predetermined timing such that a user is again made aware that she has forgotten to remove the sheets. In this way other users are not inconvenienced by the bin containing the residual sheets being exclusively reserved when an image forming apparatus connected to a network is commonly used by many users.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A printer comprising:

a receiver for receiving a job from an external device;

a print unit for printing on sheets based on the job;

a paper accommodating unit for receiving the printed sheets;

a detector for detecting a change of status of the external device or the printer;

a discriminator for discriminating whether or not sheets remain in the paper accommodating unit when the status change is detected; and a transmitter for transmitting a warning signal to the external device when residual sheets are discriminated by the discriminator.

2. A printer as claimed in claim 1, wherein said detector detects the ON state of the power source of the external device or the printer.

3. A printer as claimed in claim 1, wherein said detector detects the OFF state of the power source of the external device or the printer.

4. A printer as claimed in claim 1, wherein said detector detects the plunge into a sleep mode of the external device or the printer.

5. A printer as claimed in claim 1, wherein said detector detects the release from a sleep mode of the external device or the printer.

6. A printer comprising:

a receptor for receiving jobs from external devices;

a print unit for printing on sheet based on the job;

a plurality of bins for accommodating the printed sheets, said each bin accommodating said sheets of each job;

a detector for detecting a change of status of an external device;

a discriminator, when a status change is detected, for discriminating whether or not a bin accommodates sheets based on a print job from the external device which status change is detected; and a transmitter for transmitting a warning signal to the external device discriminated by the discriminator.

7. A printer as claimed in claim 6, wherein said warning signal includes a position signal with regard to a position of the bin accommodating sheets.

8. A printer as claimed in claim 6, wherein said detector detects the ON state of the power source of the external device.

9. A printer as claimed in claim 6, wherein said detector detects the OFF state of the power source of the external device.

10. A printer as claimed in claim 6, wherein said detector detects the plunge into a sleep mode of the external device.

11. A printer as claimed in claim 6, wherein said detector detects the release from a sleep mode of the external device.

12. A printer comprising:

a receptor for receiving jobs from external devices;

a print unit for printing on sheets based on the job;

a plurality of bins for accommodating the printed sheets, said each bin accommodating the sheets of each job;

a detector for detecting a change of status of the printer;

a discriminator, when a status change is detected, for discriminating a bin accommodating residual sheets; and a transmitter for transmitting a warning signal to an external device which output a print job corresponding to said residual sheets discharged to the bin detected by the detector.

13. A printer as claimed in claim 12, wherein said warning signal includes a position signal with regard to a position of the bin accommodating residual sheets.

14. A printer as claimed in claim 12, wherein said detector detects the ON state of the power source of the printer.

15. A printer as claimed in claim 12, wherein said detector detects the OFF state of the power source of the printer.

16. A printer as claimed in claim 12, wherein said detector detects the plunge into a sleep mode of the printer.

17. A printer as claimed in claim 12, wherein said detector detects the release from a sleep mode of the printer.

18. An image forming apparatus connectable to a plurality of external devices and having a plurality of bins for receiving sheets after image formation, said image forming apparatus comprising:

terminal discrimination means for discriminating connected external devices;

condition change detection means for detecting a change of status of the external device discriminated by the terminal discrimination means;

bin discrimination means for discriminating a bin accommodating discharged sheets after image formation of a print job received from an external device before the status is changed when the status change is detected by the condition change detection means;

sheet detection means for detecting whether or not sheets remain in a bin discriminated by the bin discrimination means; and alarm means to warn an external device when residual sheets are detected by the sheet detecting means.

19. An image forming apparatus as claimed in claim 18, wherein said detector detects the ON state of the power source of the external device.

20. An image forming apparatus as claimed in claim 18, wherein said detector detects the OFF state of the power source of the external device.

21. An image forming apparatus as claimed in claim 18, wherein said detector detects the plunge into a sleep mode of the external device.

22. An image forming apparatus as claimed in claim 18, wherein said detector detects the release from a sleep mode of the external device.

23. An image forming apparatus connectable to a plurality of external devices and having a plurality of bins for receiving sheets after image formation, said image forming apparatus comprising:

terminal discrimination means for discriminating an external device having output priority for a received print job;

bin discrimination means for discriminating a bin accommodating discharged sheets after image formation of a print job received from an external device discriminated by the terminal discrimination means;

a memory for associating and storing in memory the external devices discriminated by the terminal discrimination means and the bins discriminated by the bin discrimination means;

condition change detection means for detecting a change of status of the image forming apparatus;

sheet detection means for detecting whether or not sheets remain in a bin when the status change is detected by the condition change detection means; and alarm means to warn an external device associated with a bin of residual sheets in the associated bin when a bin accommodating residual sheets is detected by the sheet detecting means.

24. An image forming apparatus as claimed in claim 23, wherein said detector detects the ON state of the power source of the image forming apparatus.

25. An image forming apparatus as claimed in claim 23, wherein said detector detects the OFF state of the power source of the image forming apparatus.

26. An image forming apparatus as claimed in claim 23, wherein said detector detects the plunge into a sleep mode of the image forming apparatus.

27. An image forming apparatus as claimed in claim 23, wherein said detector detects the release from a sleep mode of the image forming apparatus.

* * * * *